US009375606B1

(12) United States Patent
Maresh et al.

(10) Patent No.: US 9,375,606 B1
(45) Date of Patent: Jun. 28, 2016

(54) EXERCISE METHODS AND APPARATUS

(71) Applicants: Joseph D Maresh, West Linn, OR (US); Kenneth W Stearns, Houston, TX (US)

(72) Inventors: Joseph D Maresh, West Linn, OR (US); Kenneth W Stearns, Houston, TX (US)

( * ) Notice: Subject to any disclaimer, the term of this patent is extended or adjusted under 35 U.S.C. 154(b) by 0 days.

(21) Appl. No.: 14/531,887

(22) Filed: Nov. 3, 2014

Related U.S. Application Data

(63) Continuation of application No. 13/526,515, filed on Jun. 18, 2012, now abandoned.

(51) Int. Cl.
*A63B 22/04* (2006.01)
*A63B 22/00* (2006.01)
*A63B 69/18* (2006.01)

(52) U.S. Cl.
CPC ..... *A63B 22/04* (2013.01)

(58) Field of Classification Search
CPC .... A63B 22/04; A63B 22/00; A63B 22/0048; A63B 22/20; A63B 22/06; A63B 22/0605; A63B 22/0664; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688
USPC ..... 482/51, 52, 70
See application file for complete search history.

(56) References Cited

U.S. PATENT DOCUMENTS 6,063,009 A * 5/2000 Stearns ..... A63B 21/15 482/51
6,302,825 B1 * 10/2001 Stearns ..... A63B 21/15 482/51
6,340,340 B1 * 1/2002 Stearns ..... A63B 21/15 482/52
6,409,632 B1 * 6/2002 Eschenbach ..... A63B 22/001 482/52
6,626,802 B1 * 9/2003 Rodgers, Jr. ..... A63B 21/00181 482/110
6,689,021 B2 * 2/2004 Stevens ..... A63B 23/03575 482/51
6,846,273 B1 * 1/2005 Stearns ..... A63B 22/0007 482/52
7,172,531 B2 * 2/2007 Rodgers, Jr. ..... A63B 22/001 482/52
7,874,963 B2 * 1/2011 Grind ..... A63B 22/001 482/51
8,272,995 B2 * 9/2012 Stearns ..... A63B 22/001 482/52
8,317,663 B2 * 11/2012 Stewart ..... A63B 22/001 482/51

(Continued)

*Primary Examiner* — Oren Ginsberg
*Assistant Examiner* — Garrett Atkinson
(74) *Attorney, Agent, or Firm* — Nick A Nichols, Jr.

(57) ABSTRACT

An exercise apparatus may provide a novel linkage assembly suitable for linking circular motion to relatively more complex, generally elliptical motion. Left and right rocker links may be rotatably mounted on a frame rotatable about a first axis. Left and right cranks may be mounted on the frame rotatable about a second axis. Left and right force receiving members may be movably connected between respective rocker links and cranks in such a manner that the force receiving members move through variable paths of motion that may change as a function of user applied force.

15 Claims, 8 Drawing Sheets

(56) References Cited

U.S. PATENT DOCUMENTS

2001/0056010 A1* 12/2001 Stearns ..... A63B 22/001 482/52
2002/0082146 A1* 6/2002 Stearns ..... A63B 3/00 482/38
2002/0094914 A1* 7/2002 Maresh ..... A63B 21/068 482/51
2005/0043148 A1* 2/2005 Maresh ..... A63B 21/068 482/70
2005/0049120 A1* 3/2005 Maresh ..... A63B 22/0007 482/57
2005/0101446 A1* 5/2005 Stearns ..... A63B 21/15 482/52
2005/0187073 A1* 8/2005 Krull ..... A63B 22/001 482/72
2007/0087904 A1* 4/2007 Yang ..... A63B 21/00192 482/52
2007/0161464 A1* 7/2007 Chiles ..... A63B 22/001 482/52
2007/0219061 A1* 9/2007 Rodgers, Jr. ..... A63B 21/151 482/52
2007/0219063 A1* 9/2007 Anderson ..... A63B 21/154 482/52
2010/0137110 A1* 6/2010 Rodgers, Jr. ..... A63B 21/151 482/52
2010/0173754 A1* 7/2010 Rodgers, Jr. ..... A63B 21/154 482/52
2010/0248899 A1* 9/2010 Bedell ..... A63B 22/0015 482/4
2011/0136628 A1* 6/2011 Stearns ..... A63B 22/001 482/52
2011/0281692 A1* 11/2011 Maresh ..... A63B 23/1209 482/54

* cited by examiner

EXERCISE METHODS AND APPARATUS

CROSS-REFERENCE TO RELATED APPLICATION

This application is a continuation of U.S. patent application Ser. No. 13/526,515, filed Jun. 18, 2012, which claims the benefit of U.S. Provisional Application Ser. No. 61/520,961, filed Jun. 17, 2011, which applications are incorporated herein in their entirety by reference.

BACKGROUND

The present invention relates to fitness apparatus, and in particular to fitness apparatus that constrain a user's feet and/or arms to travel along variable a path that generally changes as a function of user applied force.

Exercise equipment has been designed to facilitate a variety of exercise motions (including treadmills for walking or running in place; stepper machines for climbing in place; bicycle machines for pedaling in place; and other machines for skating and/or striding in place. Yet another type of exercise equipment has been designed to facilitate relatively more complicated exercise motions and/or to better simulate real life activity. Such equipment converts a relatively simple motion, such as circular, into a relatively more complex motion, such as elliptical. Despite various advances in the elliptical exercise category, room for improvement remains.

SUMMARY

An exercise apparatus may provide a novel linkage assembly suitable for linking circular motion to relatively more complex, generally elliptical motion. Left and right rocker links may be rotatably mounted on a frame rotatable about a first axis. Left and right cranks may be mounted on the frame rotatable about a second axis. Left and right force receiving members may be movably connected between respective rocker links and cranks in such a manner that the force receiving members move through variable paths of motion that may change as a function of user applied force.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
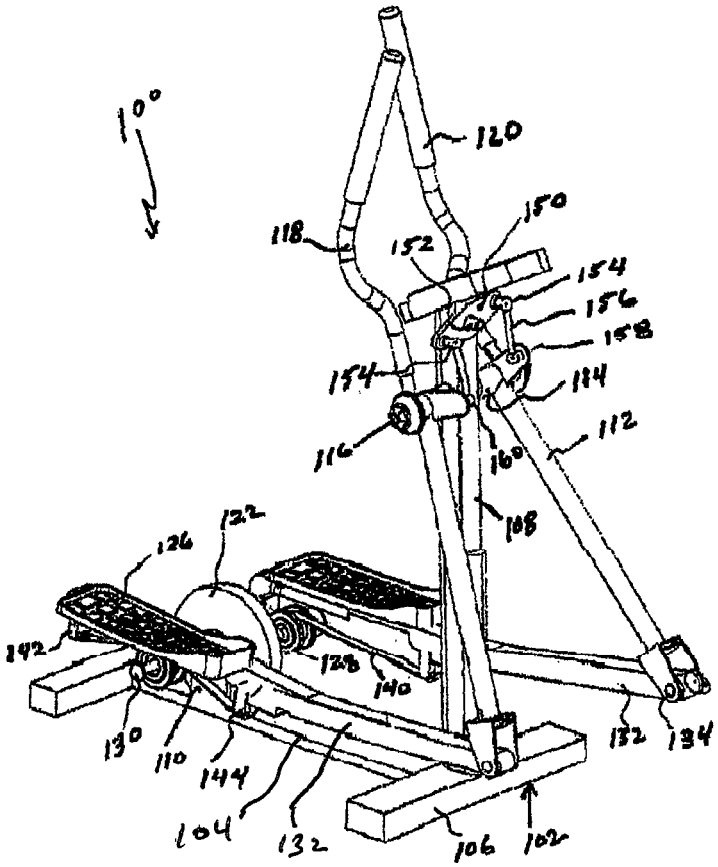
FIG. 1 is a perspective of a first embodiment of an exercise apparatus.
Figure 2:
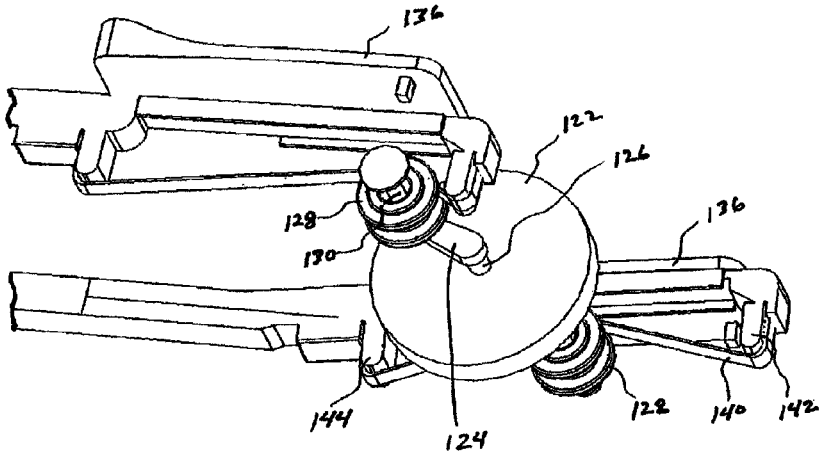
FIG. 2 is a fragmentary perspective view of a rearward portion of the exercise apparatus shown in FIG. 1.
Figure 3:
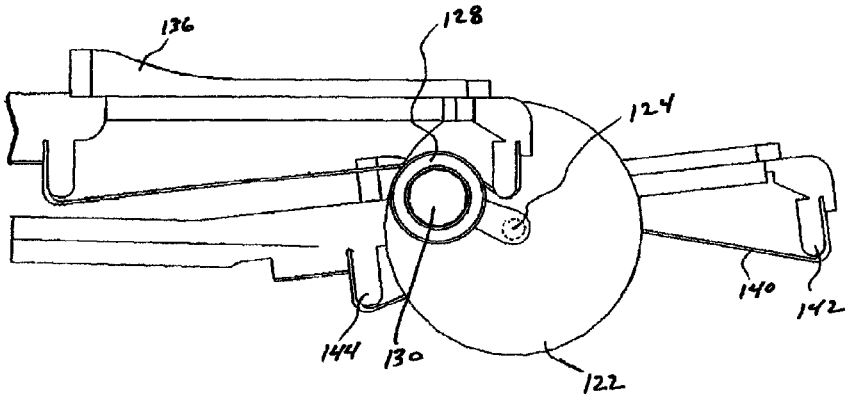
FIG. 3 is a fragmentary side view of a rearward portion of the exercise apparatus shown in FIG. 1.
Figure 4:
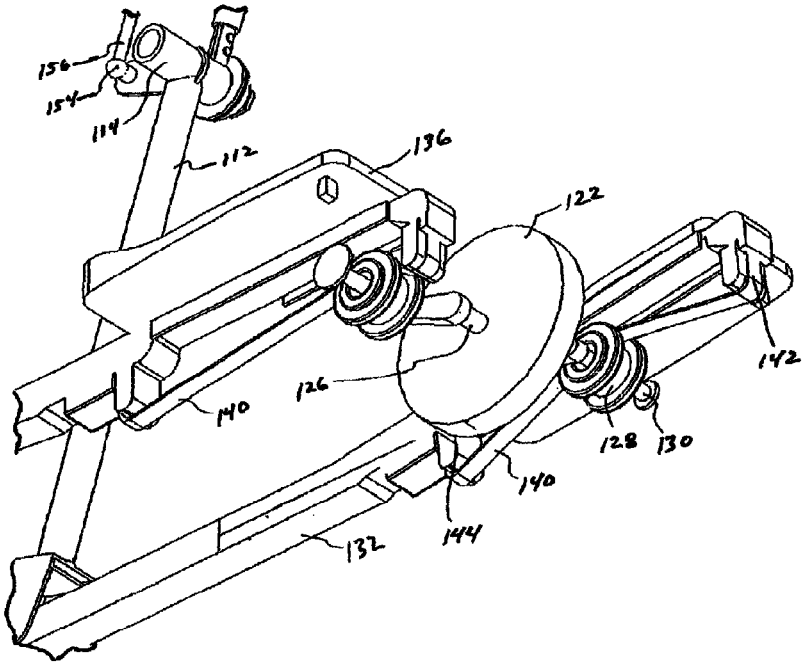
FIG. 4 is a fragmentary perspective view of a rearward portion of the exercise apparatus shown in FIG. 1.
Figure 5:
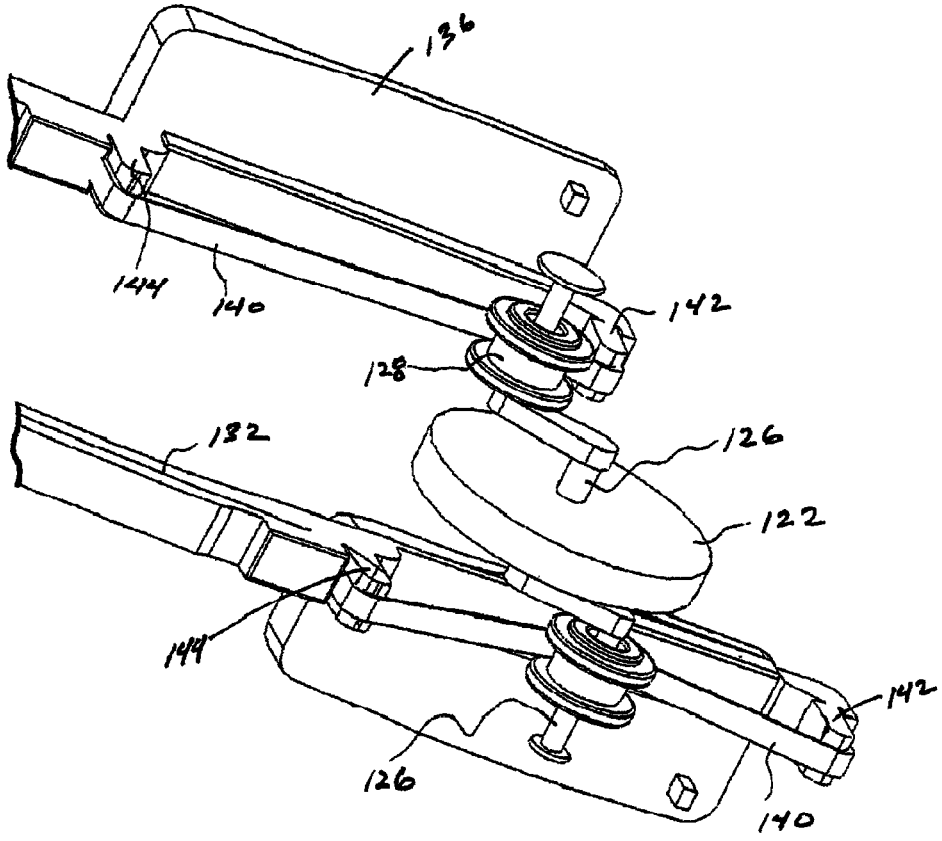
FIG. 5 is a fragmentary perspective view of a rearward portion of the exercise apparatus shown in FIG. 1.

Elliptical motion exercise apparatus may link rotation of left and right cranks to generally elliptical motion of respective left and right foot supports. The term "elliptical motion" is intended in a broad sense to describe a closed path of motion having a relatively longer major axis and a relatively shorter minor axis. In general, displacement of the cranks move the foot supports in a direction coincidental with one axis of the elliptical path, and displacement of crank driven members move the foot supports in a direction coincidental with the other axis. A general characteristic of elliptical exercise apparatus may be that the crank diameter determines the length of one axis, but does not determine the length of the other axis. As a result of this feature, a user's feet may travel through a generally elliptical path having a desirable aspect ratio, and the apparatus that embody this technology may be made relatively more compact, as well. The embodiments shown and/or described herein are generally symmetrical about a vertical plane extending lengthwise through a floor-engaging base (perpendicular to the transverse ends thereof). In general, the "right-hand" components are one hundred and eighty degrees out of phase relative to the "left-hand" components. Like reference numerals are used to designate both the "right-hand" and "left-hand" parts, and when reference is made to one or more parts on only one side of an apparatus, it is to be understood that corresponding part(s) are disposed on the opposite side of the apparatus. Also, to the extent that reference is made to forward or rearward portions of an apparatus, it is to be understood that a person can typically exercise on such apparatus while facing in either direction relative to the linkage assembly.

Referring first to FIGS. 1-5, a first embodiment of an elliptical exercise apparatus is generally denoted by the reference numeral 100. The apparatus 100 may include a frame 102 that is designed to rest upon a floor surface. The frame 102 may include a generally I-shaped base having an elongate base member 104 and transversely oriented base members 106 fixedly secured to the opposite ends of the base member 104. A forward stanchion 108 extends upward from proximate a forward end of the frame 102 and a rearward stanchion 110 extends upward from proximate an opposite, rearward end of the frame 102. The apparatus 100 is generally symmetrical about a vertical plane extending lengthwise through the frame 102, perpendicular to the transverse base members 106 at each end thereof. Those skilled in the art will also recognize that the portions of the frame 102 which are intersected by the plane of symmetry exist individually and thus, do not have any "opposite side" counterparts.

Left and right rocker links 112 may be pivotally mounted on respective sides of the stanchion 108. Each rocker link 112 extends generally downward from a rocker hub 114 that is pivotally connected to a transverse rocker shaft 116 fixed proximate the upper end of the stanchion 108. Left and right handle bars 118 are pivotally mounted on respective sides of the stanchion 108. Each handle bar 118 is rigidly connected to respective rocker hubs 114 and extends generally upward from the rocker hub 114. The upper end of each handle bar 118 may include a hand grip 120.

A crank assembly may be rotatably mounted on the rear stanchion 110. The crank assembly may include a crank disk 122 disposed between cranks 124 keyed to an axle 126 rotatably mounted on the rear stanchion 110. Rollers 128 are rotatably mounted at the distal ends of the cranks 124 about a bearing stud 130. The crank disk 122 may be connected to any of various known inertia altering devices, including, for example, a motor, a "stepped up" flywheel, an adjustable braking mechanism, or various combinations thereof.

Left and right foot longitudinal members 132 are rotatable connected to a lower distal end of rocker links 112 at a connection point 134. A foot platform 136 may be rigidly connected to each foot longitudinal member 132 proximate a distal end thereof.

A flexible member 140 may be mounted on an underlying region of each longitudinal member 132 which is in contact with a respective roller 128 as cranks 124 rotate. An anchor post 142 proximate the distal end of the longitudinal member 140 extends downwardly therefrom. An anchor post 144 spaced from the post 142 extends downardly from an intermediate portion of the longitudinal member 140. A first end of the flexible member 140 is securely fastened to a post 142 a second opposite end of the flexible member 140 is securely fastened to a post 144 so that the flexible member 140 is stretched between the anchor posts 142 and 144. The spacing between the anchor posts 142 and 144 may be adjustable in order to effect a general target range of a variable stride length. For example, increasing the distance between the anchor posts 142 and 144 will generally increase the stride length.

Flexible members 140 may be comprise any suitable material of sufficient tensile strength, such as, a strap, cable, belt, roller chain or the like. In the instance where the flexible member 140 may be a roller chain, a roller chain sprocket may be substituted for the roller 128. Adjustable tensioning of the flexible member 140 may be provided to alter the characteristics or alternatively to affect a variable foot stride range as a function of user applied force. For example, a ratcheting winch or the like may be operatively connected to the flexible member 140 for adjusting the tension of the flexible member 140.

The rocker links 112 are interconnected to move in dependent fashion in opposite directions relative to one another. A cross coupler 150 is rotatably mounted on a shaft 152 projecting from the stanchion 108 and rotatable relative thereto about a horizontal axis. The cross coupler 150 may include ball joints 154 secured proximate the distal ends of the cross coupler 150. Coupler rods 156 connect the cross coupler 150 to lobes 158 fixedly secured to the rocker hubs 114. Right and left coupler rods 156 connect respective right and left paired ball joints 154 such that the distance between right and left paired ball joints 154 remains constant. The ball joints 154 may be secured to a stud shaft 160 or the like to accommodate pivotal and rotational motions at the ball joints 154.

Figure 6:
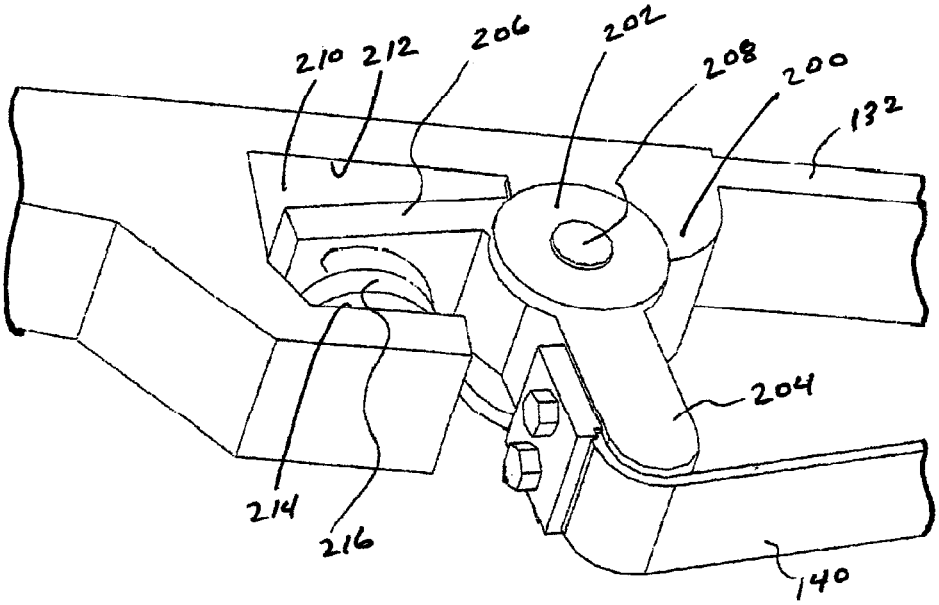
FIG. 6 is a fragmentary perspective of a rearward portion of the exercise apparatus shown in FIG. 1 featuring a modified flexible member anchor assembly.

Referring now to FIG. 6, a modified flexible member anchor assembly for automatically tensioning the flexible member 140 is illustrated in a fragmentary perspective view. The anchor assembly includes an anchor stop generally denoted by the reference numeral 200. The anchor stop 200 may include a hub 202 having a generally vertically extending arm 204 and a generally horizontally extending arm 206. The hub 202 is pivotally connected to the bottom of the force receiving member 132 proximate the distal end thereof at bearing shaft 208. The force receiving member 132 may be cut out to form a recess 210 defined between a bottom surface 212 of the force receiving member 132 and a generally horizontally extending flange or shoulder 214. A compression spring 216 may be mounted within the recess 210 on the shoulder 214. The anchor stop 200 is mounted on the force receiving member 132 with the horizontal arm 206 projecting into the recess 210 and engaging the compression spring 216. The flexible member 140 is fixedly secured to the arm 204 of the anchor stop 200 in a manner known in the art.

The compression spring 216 applies a force against the stop arm 206 to maintain the flexible member at a predetermined tension threshold. In the event the threshold tension of the flexible member 140 is exceeded, the anchor stop 200 rotates and compresses the spring 216 thereby permitting some slack in the flexible member 140 and a reduction in the flexible member tension, so that the tensile load of the flexible member 140 does not exceed a given predetermined value in order to avoid tensile load failures. Additionally, actuation of the stop 200 may impart changeable foot path characteristics dependent upon the tension of the flexible member 140.

Figure 7:
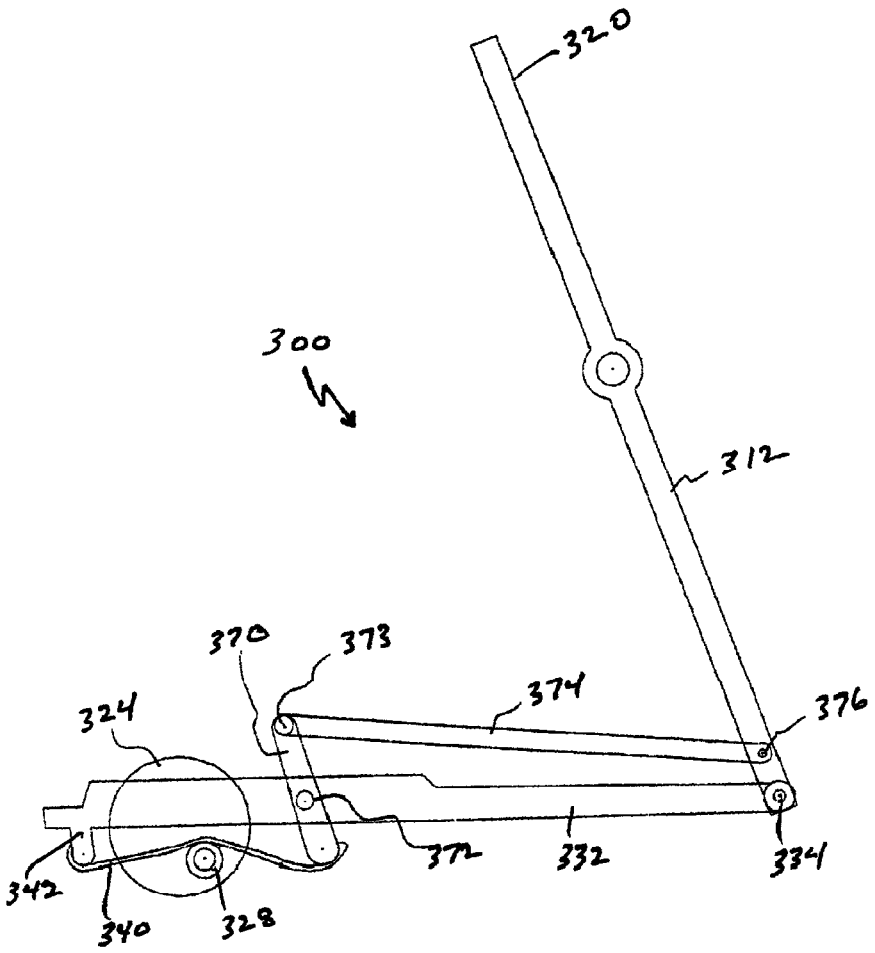
FIG. 7 is a side view of a third embodiment of an exercise apparatus depicting one side of the linkage assembly.

Referring now to FIG. 7, a third embodiment of an exercise apparatus is generally denoted by the reference numeral 300. The apparatus 300 generally includes a frame designed to rest upon a floor surface and a linkage assembly movably mounted on each side of the frame. For purposes of simplification, only the right side linkage assembly of the apparatus 300 is shown in FIG. 7. On each side of the apparatus 300, the linkage assembly generally may include a forward rocker link 312, a force receiving member 332 and a crank 324. On the apparatus 300, the crank 324 on the right side of the apparatus 300 is 180 degrees out of phase with the crank 324 on the left side of the apparatus, and the links on the right side of the apparatus 300 move in opposite directions relative to their left side counterparts. However, like reference numerals are used to designate both the "right side" and "left side" parts on the apparatus 300, and in general, when reference is made to one or more parts on only one side of the apparatus 300, it is to be understood that corresponding part(s) are disposed on the opposite side of the apparatus 300.

On each side of the apparatus 300, a crank disk 324 is keyed to a common shaft rotatably mounted proximate the rear of the frame by means know in the art. A conventional drag strip or other known resistance device may be connected to the crank disk 324 to resist rotation.

One each side of the apparatus 300, a force receiving member 332 has a forward end rotatably connected to lower end of a respective rocker link 312 at a connection point 334. Each rocker link 312 is rotatably mounted to an upstanding forward stanchion of the apparatus frame. An upper end of each forward rocker link 312 may be sized and configured into a hand grip 320.

A flexible member 340 may be mounted on an underlying region of each force receiving member 332. The flexible member 340 is in contact with a respective roller 128 mounted on each respective crank 324. An anchor post 342 is mounted proximate the distal end of the force receiving member 340 and extends downwardly therefrom. One end of the flexible member 340 is securely fastened to the anchor post 342. The opposite end of the flexible member 340 is securely fastened to lower end of an anchor link 370 that is rotatably secured to the force receiving member 332 at bearing 372. A drawbar 374 has a distal end rotatably connected to an upper end of the anchor link 370 at bearing 373 and a proximal end rotatably connected to the rocker link 312 at bearing 376.

In the configuration of the apparatus 300 shown in FIG. 7, the orientation of the anchor link 370 changes as a function of the orientation of the rocker link 312. Thus, the flexible member 340 is under more or less tension as the lower end of the anchor link 370 moves toward or away from the anchor post 342. Manipulation of the anchor link 370 may affect the foot path shape and/or size, as well as impart more subtle path characteristics that may be perceived by the user.

Figure 8:
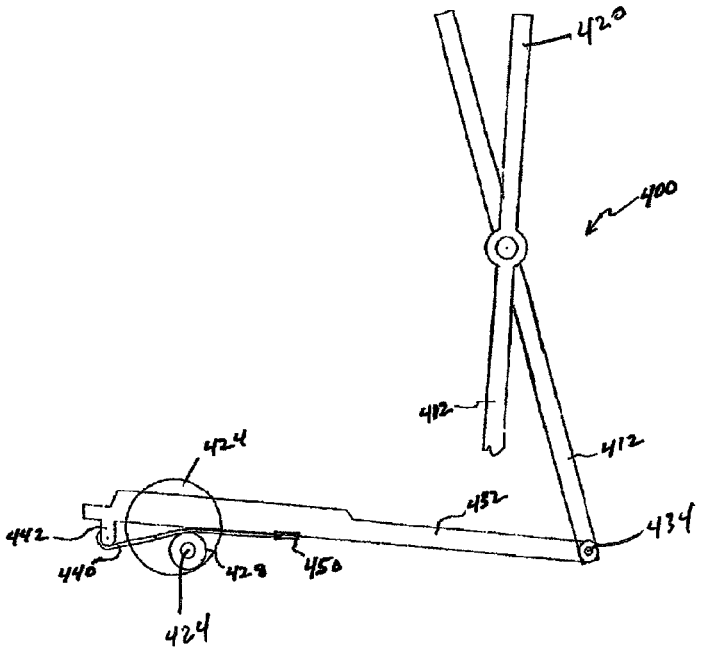
FIG. 8 is a fragmentary side view of a fourth embodiment of an exercise apparatus depicting one side of the linkage assembly.

Referring now to FIG. 8, a fourth embodiment of an exercise apparatus is generally denoted by the reference numeral 400. The apparatus 400 generally includes a frame designed to rest upon a floor surface and a linkage assembly movably mounted on each side of the frame. For purposes of simplification, only the right side linkage assembly of the apparatus 400 is shown in FIG. 8. On each side of the apparatus 400, the linkage assembly generally may include a forward rocker link 412, a force receiving member 432 and a crank 424. On the apparatus 400, the crank 424 on the right side of the apparatus 400 is 180 degrees out of phase with the crank 424 on the left side of the apparatus, and the links on the right side of the apparatus 400 move in opposite directions relative to their left side counterparts. However, like reference numerals are used to designate both the "right side" and "left side" parts on the apparatus 400, and in general, when reference is made to one or more parts on only one side of the apparatus 400, it is to be understood that corresponding part(s) are disposed on the opposite side of the apparatus 400.

On each side of the apparatus 400, a crank disk 424 is keyed to a common shaft rotatably mounted proximate the rear of the frame by means know in the art. A conventional drag strip or other known resistance device may be connected to the crank disk 424 to resist rotation.

One each side of the apparatus 400, a force receiving member 432 has a forward end rotatably connected to lower end of a respective rocker link 412 at a connection point 434. Each rocker link 412 is rotatably mounted to an upstanding forward stanchion of the apparatus frame. An upper end of each forward rocker link 412 may be sized and configured into a hand grip 420.

A flexible member 440 may be mounted on an underlying region of each force receiving member 432. The flexible member 440 is in contact with a respective roller 428 mounted on each respective crank 424. An anchor post 442 is mounted proximate the distal end of the force receiving member 432 and extends downwardly therefrom. One end of the flexible member 440 is securely fastened to the anchor post 342. The opposite end of the flexible member 440 is secured substantially flush with the underside of the force receiving member 432 at bracket 450. The reader will note that because a cross connect coupler (described above with reference to apparatus 100) the stride length is limited at both the right and left force receiving members 432. Essentially, the cross connect coupler establishes instantaneous reciprocal movement of the force receiving members 432 such that as the movement of one force receiving member 432 is limited as the crank roller 428 approaches the anchor stop 442, the movement of the opposite force receiving member 432 is limited due to forces transmitted through the cross connect coupler. At this instant in time the opposite force receiving member 432 is at its forward position upon reversing directions.

While a preferred embodiment of the invention has been shown and described, other and further embodiments of the invention may be devised without departing from the basic scope thereof, and the scope thereof is determined by the claims which follow.

The invention claimed is:

1. An exercise apparatus, comprising:

a) a frame configured to rest on a floor surface;

b) a left rocker link and a right rocker link, wherein each said rocker link is mounted on a respective side of said frame;

c) a left crank and a right crank, wherein each said crank is mounted on a respective side of said frame;

d) a left force receiving link and a right force receiving link, wherein a forward end of each said force receiving link is pivotally connected to a lower end of a respective said rocker link;

e) an elongated flexible member mounted on an underside region of each said force receiving link, wherein a first distal end of said flexible member is fixedly secured proximate a rearward end of a respective said force receiving link and a second distal end of said flexible member is fixedly secured to an intermediate portion of a respective said force receiving link, and wherein said flexible member is in a spaced relationship with a respective said force receiving link; and f) a left roller and a right roller, wherein each said roller is rotatably mounted on a respective said crank and wherein each said roller is in rolling contact with a respective said flexible member.

2. The exercise apparatus of claim 1 including a cross coupler link pivotally mounted on said frame, said cross coupler link interconnecting said left rocker link and said right rocker link, whereby said left rocker link and said right rocker are constrained to move in synchronized fashion in opposite directions relative to one another.

3. The exercise apparatus of claim 1 wherein each said force receiving link includes a downwardly extending first post proximate a distal end of said force receiving link and a second post extending downwardly from an intermediate portion of said force receiving link and wherein the first distal end of said flexible member is fixedly secured to said first post and the second distal end of said flexible member is fixedly secured to said second post.

4. The exercise apparatus of claim 1 including a tensioning assembly mounted on each said force receiving link for adjusting the tension of said flexible member.

5. The exercise apparatus of claim 4 wherein said tensioning assembly includes a bracket pivotally connected to said force receiving link, said bracket having a generally horizontally extending first arm and a generally downwardly extending second arm, wherein the first distal end of said flexible member is fixedly secured to the second arm of said bracket, and the first arm of said bracket is in cooperative engagement with a compression spring secured in a recess of said force receiving link.

6. The exercise apparatus of claim 4 wherein said tensioning assembly includes a connector link pivotally mounted on each of said force receiving link, wherein the second distal end of said flexible member is fixedly secured to a lower distal end of said connector link, and further including a drawbar interconnecting said connector link to said rocker link.

7. The apparatus of claim 1 wherein either of said first or second distal end of each said flexible member is securely fastened flush with a bottom surface of a respective said force receiving link.

8. The exercise apparatus of claim 1 wherein said second distal end of each flexible member is connected flush with a bottom surface of a respective foot support link.

9. An exercise apparatus, comprising:

a) a frame configured to rest on a floor surface;

b) a left rocker link and a right rocker link, wherein each rocker link is mounted on a respective side of the frame;

c) a left crank and a right crank, wherein each crank is mounted on a respective side of the frame;

d) a left foot support link and a right foot support link, wherein each foot support link is movably connected between a respective rocker link and a respective crank;

e) a cross-coupler link pivotally mounted on the frame interconnecting the left rocker link and the right rocker link;

f) an elongated flexible member fixedly secured to a bottom surface of each foot support link, wherein a first distal end of the flexible member is fixedly secured proximate a rearward end of the foot support link and a second distal end of the flexible member is fixedly secured proximate an intermediate portion of the foot support link, and wherein the flexible member is in spatial relationship with the foot support member; and g) a left roller and a right roller rotatably mounted on a respective crank, and wherein each flexible member is movably supported on a respective roller.

10. The exercise apparatus of claim 9 including a bracket pivotally connected to the foot support link, the bracket having a generally horizontally extending first arm and a generally downwardly extending second arm, wherein the first arm of the bracket is in cooperative engagement with a compression spring secured in a recess of the foot support link and the first distal end of the flexible member is fixedly secured to the second arm of the bracket.

11. The exercise apparatus of claim 9 including a connector link pivotally mounted on each foot support link, wherein the second distal end of the flexible member is fixedly secured to a lower distal end of the connector link, and further including a drawbar interconnecting said connector link to said rocker link.

12. An exercise apparatus, comprising:

a) a frame configured to rest on a floor surface;

b) a left rocker link and a right rocker link, wherein each said rocker link is mounted on a respective side of said frame;

c) a left crank and a right crank, wherein each said crank is mounted on a respective side of said frame;

d) a left foot support link and a right foot support link, wherein each said foot support link is movably connected between a respective said rocker link and a respective said crank;

e) a coupler link pivotally mounted on said frame interconnecting said left and right rocker links, whereby said left and right rocker links are constrained to move in synchronized fashion in opposite directions relative to the frame;

f) a left flexible member and a right flexible member, wherein each said flexible member is mounted on a bottom surface of a respective said foot support link; and g) a left roller and a right roller rotatably mounted on a respective said crank, and wherein each said flexible member is movably supported on a respective said roller.

13. The exercise apparatus of claim 12 including a tensioning assembly mounted on each said foot support link for adjusting the tension of a respective said flexible member.

14. The exercise apparatus of claim 13 wherein the tensioning assembly includes a connector link pivotally mounted on each said foot support link, wherein a distal end of each said flexible member is fixedly secured to a lower distal end of a respective said connector link, and further including a drawbar movably connecting said connector link to said rocker link.

15. An exercise apparatus, comprising:

a) a frame configured to rest on a floor surface;

b) left and right linkage assemblies mounted on a respective side of the frame, each linkage assembly operably connected between a crank rotatably mounted on a respective side of the frame and a rocker link pivotally mounted on a respective side of the frame, each said linkage assembly including:

(i) a foot support link having a forward distal end pivotally connected to a lower distal end of the rocker link; and (ii) an elastic member mounted below the foot support link, wherein an end of the elastic member is fixedly secured to a post extending downwardly from the foot support link and an opposite end of the elastic member is mounted flush with a bottom surface of the foot support link, wherein the elastic member is movably supported on a roller rotatably mounted on the crank;

c) wherein a user's foot motion imparts a force on respective foot support links transmitted to a respective flexible member for rotating a respective crank.

* * * * *